US006659382B2

(12) United States Patent
Ryczek

(10) Patent No.: US 6,659,382 B2
(45) Date of Patent: Dec. 9, 2003

(54) SECURITY DEVICE FOR DISPLAY OF HAND HELD ITEMS

(75) Inventor: Richard Ryczek, Butler, NJ (US)

(73) Assignee: Vira Manufacturing, Inc., Perth Amboy, NJ (US)

( * ) Notice: Subject to any disclaimer, the term of this patent is extended or adjusted under 35 U.S.C. 154(b) by 0 days.

(21) Appl. No.: 09/902,141

(22) Filed: Jul. 10, 2001

(65) Prior Publication Data

US 2003/0010859 A1 Jan. 16, 2003

(51) Int. Cl.[7] ..... B65H 75/48; B65H 75/28; F16B 41/00

(52) U.S. Cl. ..... 242/379; 242/402; 403/408.1

(58) Field of Search ..... 242/379, 375, 242/376, 380, 402; 248/309.1, 176.1; 403/289, 290, 373, 374.1, 374.2, 374.3, 408.1; 191/12.2 R

(56) References Cited

U.S. PATENT DOCUMENTS

| | | | | | |
|---|---|---|---|---|---|
| 665,800 | A | | 1/1901 | Reno | |
| 2,638,041 | A | * | 5/1953 | Horydczak | 396/423 |
| 3,797,947 | A | * | 3/1974 | Foote | 403/23 |
| 5,124,685 | A | | 6/1992 | Rankin | |
| 5,146,205 | A | * | 9/1992 | Keifer et al. | 340/540 |
| 5,246,183 | A | | 9/1993 | Leyden | |
| 5,305,381 | A | | 4/1994 | Wang et al. | |
| 5,457,745 | A | | 10/1995 | Wang | |
| 5,463,688 | A | | 10/1995 | Wijas | |
| 5,513,785 | A | * | 5/1996 | Campagna, Jr. | 224/162 |
| 5,552,771 | A | * | 9/1996 | Leyden et al. | 340/548 |
| 5,555,302 | A | | 9/1996 | Wang | |
| 5,603,416 | A | * | 2/1997 | Richardson et al. | 211/4 |
| 5,685,436 | A | * | 11/1997 | Davet | 211/85.5 |
| 5,694,468 | A | | 12/1997 | Hsu | |
| 5,788,202 | A | | 8/1998 | Richter | |
| 5,828,750 | A | | 10/1998 | Perala | |
| 5,836,563 | A | | 11/1998 | Hsin-Yung | |
| 5,898,775 | A | | 4/1999 | Niemo et al. | |
| 5,903,645 | A | | 5/1999 | Tsay | |
| 5,913,487 | A | | 6/1999 | Leatherman | |
| 5,956,399 | A | | 9/1999 | Whitley et al. | |
| 5,961,016 | A | | 10/1999 | Hartmann et al. | |
| 5,964,385 | A | * | 10/1999 | Simon | 135/66 |
| 6,002,765 | A | | 12/1999 | Frank | |
| 6,002,921 | A | | 12/1999 | Pfahlert et al. | |
| 6,035,036 | A | | 3/2000 | Eisenbraun et al. | |
| 6,039,496 | A | | 3/2000 | Bishop | |
| 6,073,901 | A | | 6/2000 | Richter | |
| 6,138,041 | A | | 10/2000 | Yahia | |
| 6,140,923 | A | | 10/2000 | Lam | |
| 6,419,175 | B1 | * | 7/2002 | Rankin, VI | 242/373 |

* cited by examiner

*Primary Examiner*—Kathy Matecki
*Assistant Examiner*—Scott J. Haugland
(74) *Attorney, Agent, or Firm*—Bazerman & Drangel PC

(57) ABSTRACT

An apparatus for displaying mobile phones and other hand-held devices comprising a clamping system, a retracting system, and a positioning system. The clamping system holds a hand-held device between two parts, which are fastened together by a fitting and a security screw having a head with a slot requiring a special key. The retracting system includes a retractable tethering cable wound on a spool. The positioning system includes a male component, which anchors the tethering cable to the fitting, and a female component, which is mounted on the retracting system. The tethering cable passes through the female component of the positioning system so that when the hand-held device is retracted, the male component of the positioning system is received by the female component thus assuring proper orientation of the hand-held device on display.

20 Claims, 6 Drawing Sheets

SECURITY DEVICE FOR DISPLAY OF HAND HELD ITEMS

BACKGROUND OF THE INVENTION

1. Field of the Invention

This invention relates to a security device for display of electronic hand held items and, in particular, to a device for marketing mobile phones which allows a potential customer to hold a phone at a limited distance from a display stand while automatically retracting and correctly positioning the hand held device on the display stand after its release.

2. Prior Art

With the growth of electronic devices in general and the ability to miniaturize in particular, light weight hand held mobile phones and similar devices have become pervasive. Items, such as cell phones, and hand held computers are sold to the public in a wide range of stores. To properly market such devices, consumers need to assure themselves that they can comfortable be used and manipulated by his/her hands In other words the consumer must be free to hold the device. But by allowing a consumer to inspect the item, the retailer is subjecting themselves to substantial loss through theft and other forms of shrinkage and breakage. It is equally important for marketing of cell phones and hand held computers that they be displayed in an upright position. Various attempts have been made to make retail displays which allow manipulation of displayed items while attempting to prevent theft.

For example U.S. Pat. No. 5,246,183 issued on Sep. 21, 1993 to Leyden discloses a tethering device for use in locations such as motel rooms that allows a remote control to be used but prevents its removal from the room. A spring in combination with a spool and cable allows a user to pull a hand-held remote control from a fixed position and automatically returns a the hand-held remote control back to its original location. It is not a display device for marketing. It does not guide the displayed item after release into a desired upright display position. There is simply no mechanism for turning the hand held remote upright.

While there have been a number of holders for hand held telephone, hand held computers and the like, they have been for the purpose of facilitating carrying and using the device rather than for security in display and marketing. There has been no mechanism as such for securing a mobile phone on a display but rather various devices that achieve the reverse. Such devices come with a variety of quick release mechanisms. See for example U.S. Pat. No. 5,903,645 issued on May 11, 1999 to Tsay; U.S. Pat. No. 5,555,302 issued on Sep. 10, 1996 to Wang.

While U.S. Pat. No. 6,002,921 issued on Dec. 14, 1999 to Pfahlert and Philips discloses a lockable cradle for holding a radiotelephone for use in vehicles it is released by a radio signal. This vehicle mounted device must be of a special construction and size to mate with the security system having grooves. It is neither designed for use in display systems, with existing devices, nor with a retracting and positioning system of the present invention.

SUMMARY OF THE INVENTION

The present invention for displaying mobile phones and other hand-held devices is comprised of three major components: a clamping system, a retracting system and a positioning system.

The clamping system of the present invention comprises two parts which are fastened together around a fitting attached to the end of a cord. The fitting may have a hole drilled through it to allow such a fastening. A security screw or bolt holds the two parts together with a key required to turn the head of the bolt or screw. The clamping system is locked onto the fitting and cannot be removed without the proper key. The clamping system has a lip on two opposite sides which prevents a person from removing the hand held device when the clamping system is fastened to the fitting and the hand held device is within the lips of the clamping system and attaches to a cable with a device also having a positioning guide to assure proper orientation of the hand-held device on display.

The retracting system comprises a coil spring, a spool and a cord mounted in a common decorative housing on which the mobile phone or the like rests. One end of the coil spring connects to the spool and the other end is attached to the housing. The cord is wrapped around the spool with one end attached to the spool and the other end attached to the mobile phone. When the mobile phone is moved from the housing the spool is turned and the coil spring is placed in tension. When the phone is released, the coil spring returns the spool to its original position.

The present invention has a positioning system to bring the cell phone back to its desired display position. The cord attached to the spool and the telephone is made from a relatively stiff material such as braided steel wire or cable. Thus, if the cord is pulled from the display stand and the cell phone is twisted or turned, the cord will develop a counter force to return the cell phone, upon release, to the original, upright position. To guide the hand held device into the proper position, the cord has on the end that emerges from the housing a first half of a positioning system which connects to the clamping system. The positioning system comprises interlocking or complementary male and female fittings. The fitting attached to the end of the cord may be either male or female with a corresponding mating fitting mounted on the housing. The cross-section of the male-female fitting pair may be of any shape other than circular with ovoid shapes preferred and cross-sectional ovoid shapes having guiding ribs contained within the ovoid female cross-section or on the exterior of the male ovoid cross-section most preferred. A non-circular shape, such as an ovoid, along with the ribs will assure that when the male fitting enters its female counterpart, the orientation of the fitting at the end of the cord will be the same as when the fitting, clamping system, or any device held within the clamping system, was pulled. The ribs assist with the guidance of the male fitting into the female fitting and assure that the fitting will return to its intended display orientation. Thus, the security display device of the present invention meets the needs of consumers and merchants by enabling a potential purchaser to conveniently examine a hand-held item such as a cell phone, conventional phone, camera, personal organizer and the like while preventing its theft and guaranteeing its return to a suitable display position when released after examination.

DETAILED DESCRIPTION OF THE INVENTION

Figure 1:
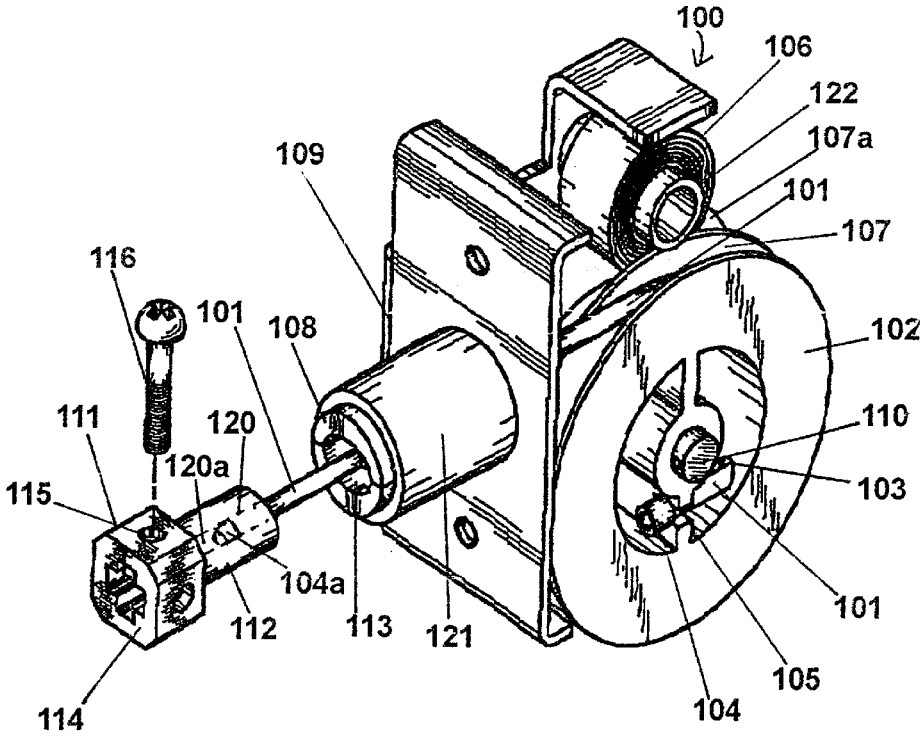
FIG. 1 depicts a version of the cable retracting component of the present invention having a coupling to a clamping device or security claw and a security bolt to fasten the coupling to the clamping device.

FIG. 1. shows a version of the retracting mechanism 100 of the present invention. A cord or security cable 101 is wrapped around a plastic double spool 102 having a channel 107 around which the cable 101 is wrapped and an adjacent channel 107*a* around which a constant force spring 106 is wrapped. The spool 102 is placed on an axle 110 which allows the spool 102 to rotate on its axis perpendicular to its circumference. The present invention contains a means for mounting the axle 110 to a housing plate 109. A circular collar or ring 104 attached to one end of cable 101 is used to secure it to spool 102 while a non-circular collar 104*a,* preferably of ovoid cross-section is attached to the other end of the cable which is connected to coupling fitting 111 having male positioning component 112. A channel 120 passes through positioning component 112 which contains cable 101. Channel 120 has a generally circular cross-section in the general area at which cable 101 enters positioning component 112 but as it continues through, positioning component 112 has a non-circular cross-section 120*a* and altered dimensions to snugly retain non-circular collar 104*a* within channel 120 and prevent rotation of fitting 111 around cable 101. The cable 101 is secured to the spool 102 by passing the cable 101 through an opening 103 in the spool 102 and inserting the cable 101 into a clip 105 located on the spool 102. The clip secures to the cable so that when cable 101 is pulled ring 104 will not pass through clip 105 and will prevent any detachment of the cable 101 from the spool 102.

A recoil or constant force spring 106 is connected to the spool 102 in spool channel 107*a* so as to not interfere with the cable 101 while the cable 101 is being released from or rewound onto the spool 102. Constant force spring 106 is retained on spool 102 in channel 107*a* by means of a slot in the spool core. A length of the constant force spring 106 extends from the reel and coils around rod 122 which is connected to housing plate 109 The constant force spring 106 is arranged so that it is wound onto spool 102 as cable 101 is drawn off the spool, thus exerting a retracting force on cable 101. The coil of constant force spring 106 is positioned between the walls of channel 107*a* of double spool 102 thereby holding spring 106 in place on rod 122. The constant force spring 106 is arranged so that it is wound onto spool 102 from the coil on rod 122 as cable 101 is drawn off the spool, thus exerting a retracting force on cable 101. When tension on cable 101 is released spring 106 retracts onto the coil on rod 122 thus rewinding cable 122 onto spool 102.

When cable 101 is retracted by spring 106 after having been extended, male positioning component 112 enters a female positioning component or fitting 108, of a male/female positioning fitting couple, that is mounted within flange 121. The ovoid male positioning component 112 fits into opening 113, having an ovoid cross-section, on the female positioning component. Flange 121 is attached to housing plate 109 and surrounds an opening in housing plate 121 through which cable 101 passes.

The coupling fitting 111, having male positioning component 112, also has incorporated into it the security claw linkage 114. The security claw linkage 114 has a hole 115 drilled through it so as to allow a security screw 116 to fit through the linkage 114.

Figure 2:
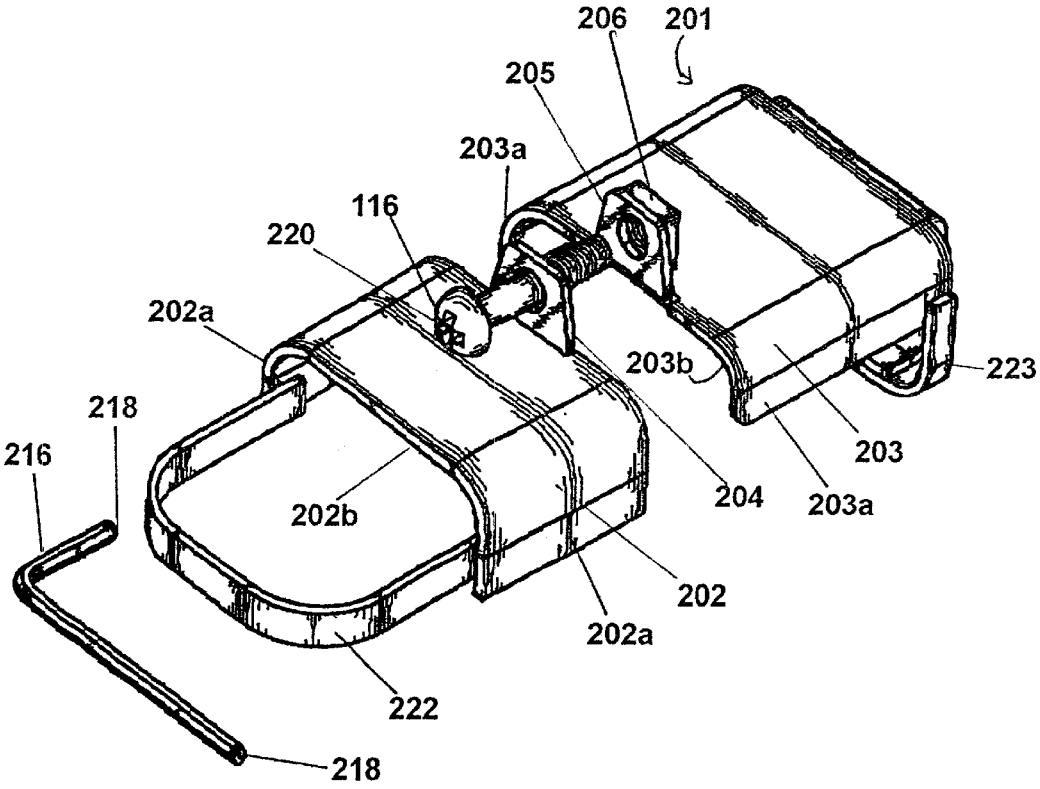
FIG. 2 depicts a back view of a version of a clamping device or security claw of the present invention.
Figure 2A:
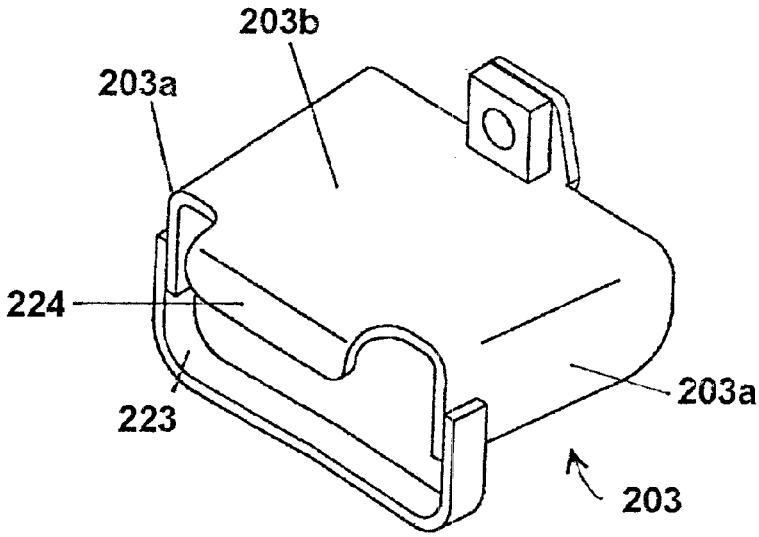
FIG. 2*a* shows the lower section of a clamping device or security claw of FIG. 2.

FIG. 2 shows a version of a security claw 201. The top section 202 connects or locks to the lower section 203 with the use of a security screw 116 which can be opened and closed with security key 216. The top section 202 has attached to it a tab 204 has an opening that is sufficiently large to allow passage of the shaft but not the head of security screw 116. The lower section 203 has a threaded tab 205 to receive safety screw 116. To facilitate opening the security claw to insert or remove display merchandise it is preferred that only one tab be threaded. The tabs themselves may be threaded or, as shown for tab 205, a threaded nut 206 can be attached to the tab. Both tabs 204 and 205 must be wide enough to allow the security screw 116 to be placed through it so that the security claw 201 is securely fastened to the security claw linkage 114. Security key 216 has ends 218 that are shaped to fit into a non-conventional opening or slot 220 in the head of security screw 116. Non-conventional openings or slots 220 on security screw 116 which security key 216 is shaped to fit might for example have star, cruciform, circular or non-circular cross-sections and also have concavities and convexities within the opening 220. Top section 202 and lower section 203 together comprise a cradle to contain a hand-held device such as a cell phone. Each section may be formed as a complete unit from metal, plastic or any other strong rigid material capable of securely containing a hand held device or as in the version depicted in FIG. 2 it may be formed from more than one piece. As shown in FIG. 2 the upper section has sides 202*a* and a bottom 202*b* to contain a device on three sides. In the version of the security claw depicted in FIG. 2 each of the two legs of a U-shaped brace 222 is connected to a separate side 202*a* of top section 202 to contain a device on a fourth side. Lower section 203 has sides 203*a* and a bottom 203*b* to contain a device on three sides. As seen in FIG. 2A bottom 203*b* extends to form a lip 224 to enclose a device on a fourth side. Lip 224 may extend to brace 223 and be connected to it if necessary to securely enclose a device. Each leg of U-shaped brace 223 is connected to a separate side 203*a* forming a bridge over bottom 203*b* to secure a device on a sixth side.

Figure 3:
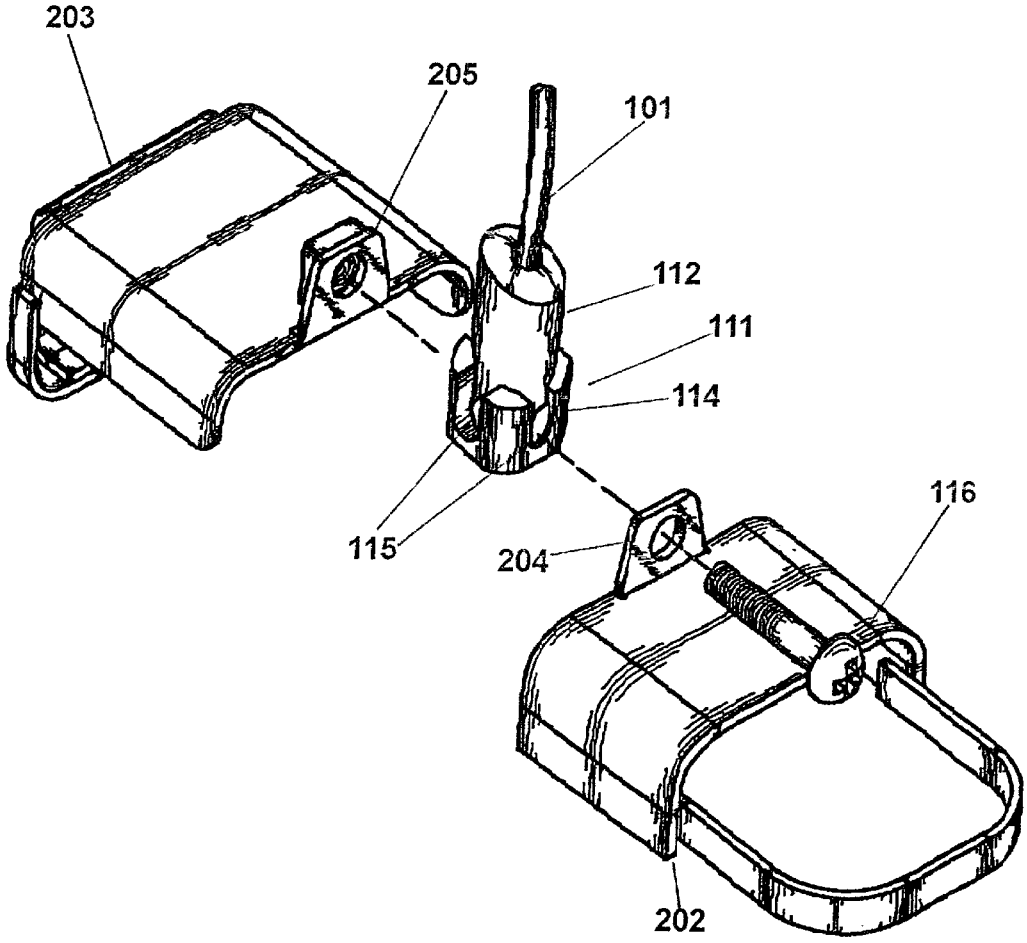
FIG. 3 is a reverse view of the clamping device of FIG. 2 showing the assembly of the clamping device to a connecting cable coupling having a version of a male component of the positioning fitting.

FIG. 3 is a back view of the clamping device of FIG. 2 showing the assembly of the clamping device to a version of a coupling fitting 111 having an ovoid version of a male component 112 of the male/female positioning fitting. Security screw 116 is inserted through the unthreaded opening in tab 204 on the back of security claw 201, through the opening 115 in the security claw linkage 114 of coupling fitting 111, and into the opening of threaded tab 205 and tightened with security key 218 shown in FIG. 2. As shown in FIG. 3, coupling fitting 111 is generally arranged so that cable 101 extends from the back of security claw 201 although in other versions fitting 111 may be modified, by means known in the art, to permit security cable 101 to conveniently extend from the side of security claw 201.

Figure 4:
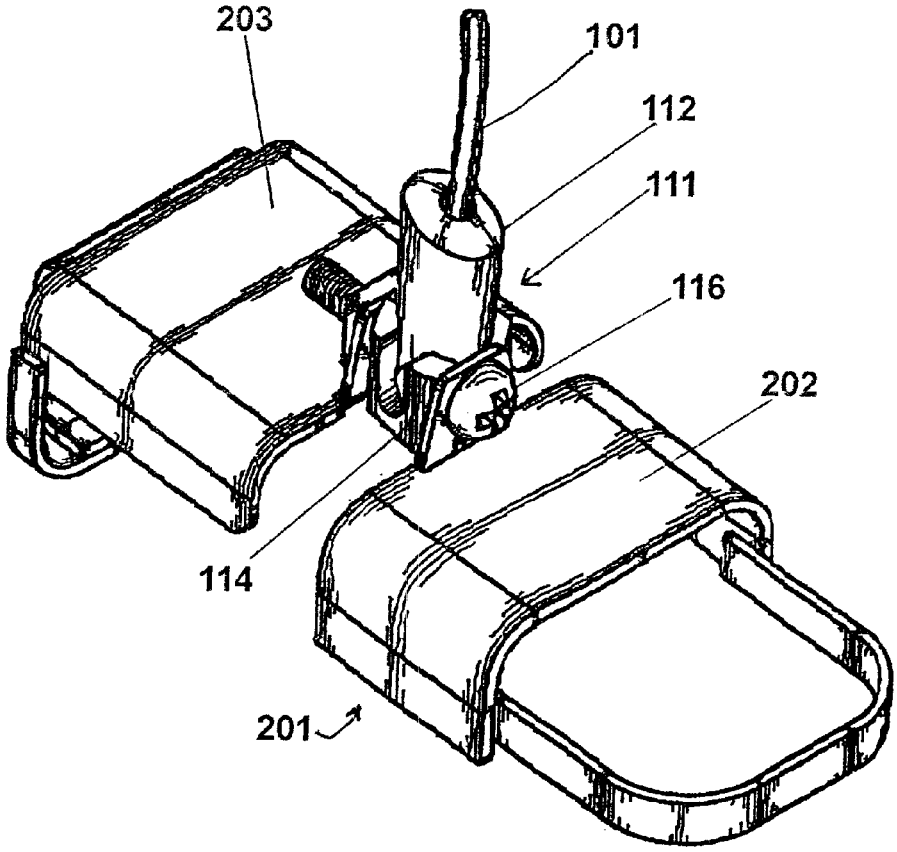
FIG. 4 is a back view of the fully assembled clamping device of FIG. 3 coupled to a connecting cable and secured with a security nut and bolt.

FIG. 4 depicts the version of security claw 201 and coupling fitting 111 shown in FIG. 3 as fully assembled and secured with security screw 116. In practice, a hand-held device such as a cell phone is inserted into the claw 201 before it is fully assembled and coupled to security cable 101. For example an appropriately shaped cell phone is inserted into lower section 203 so that the lower part of the phone fits under brace 223 with the face of the phone facing away from bottom 203*b*. As shown in FIG. 3 coupling fitting 111 is inserted between top section 202 and bottom section 203. Top section 202 is then slipped over the top of the cell phone and coupled to bottom section 203 through coupling fitting 111 by means of security screw 116 which is securely tightened into threaded tab 205. As will be apparent to those skilled in the art the form of upper component 202 and lower component 203 of security claw 201 may be varied depending on the shape and dimensions of the cell phone or other hand-held device to be securely held therein. Regardless of form each security claw will comprise an upper and a lower component having tabs 204 and 205 so that the upper and lower component of the security claw can be coupled by means of coupling fitting 111 and securely held by security screw 116 as illustrated by the example depicted in FIG. 4.

The retracting system to which cable 101 is attached is typically securely mounted on a display unit. When the displayed cell phone is examined it is pulled away from the retracting unit 100, but securely held by cable 101 attached to security claw 201. Upon release the retracting force developed by constant force spring 106 draws the cable back onto spool 102 causing the cell phone to be pulled towards its initial display position. Due to non-circular collar 104*a* held in non-circular channel 120*a* and the stiffness the cell phone coupled with fitting 111 cannot freely rotate around tethering cable 101 and will also tend to return to its initial rotational orientation upon release. A non-circular, male positioning component such as component 112 of FIG. 1 having an ovoid cross-section is used since it must be properly oriented to enter a corresponding non-circular, female positioning component such as component 108 having an opening 113 with an ovoid cross-section thus insuring that the cell phone returns to its original display position.

Figure 5:
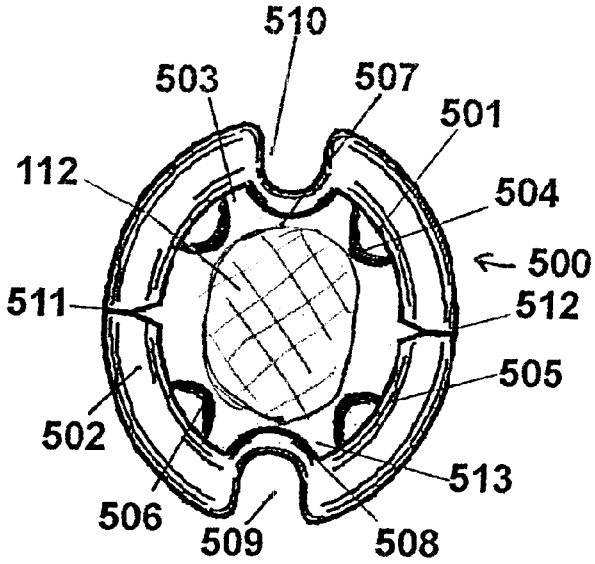
FIG. 5 is a cross-sectional view showing a version of a female component of the positioning fitting having ribs containing the male positioning component depicted in FIGS. 3 and 4.

Another version of a female positioning component to receive an ovoid cross-section male positioning component is seen in FIG. 5. Female positioning component 500 generally comprises a tubular structure having walls 501 and 502 enclosing a lumen 513. Rounded rails 503, 504, 505, 506, 507 and 508 traverse the length of the interior surface of walls 501 and 502 facing lumen 513 and are substantially parallel and guide male ovoid cross-section positioning component into lumen 513. Generally, the rounded rails are arranged along the length of lumen 513 so that their rounded surfaces come into generally tangential contact with the sides of the male positioning component having an ovoid cross-section. Female positioning components having rails are preferred as this arrangement reduces friction relative to the female positioning component 108 that has a completely ovoid cross-section thereby facilitating the rapid return of the secured hand-held unit to its initial display position. In another preferred version of female positioning component 500 the rounded rails are slightly recessed from the entrance to lumen 513 to facilitate slight rotation to the initial display position in the event that cable 101 is slightly twisted. Female positioning component 500 is generally formed from two identical segments 501 and 502, that are joined at seams 511 and 512 generally by press fitting into flange 121 of FIG. 1. Notches 509 and 510 facilitate press fitting into flange 121. The positioning and coupling fittings of the present invention may be formed or processed from any rigid material known in the art that may be machined, molded or otherwise formed into a desired shape by means commonly known and practiced in the art. Relatively tough, rigid plastics that may be machined and press fit such as machinable grades of polyvinylchloride (PVC) and other machinable plastics are preferred. Each positioning component may be formed as a single unit or in two or more units that are joined by press fitting, welding and adhesive means as commonly known and practiced in the art. Combinations of materials such as metal and plastic, different metals and different plastics may be used for the female and male positioning components of the present invention.

The apparatus for secure display of hand held items of the present invention may be used singly or in multiple arrays on display structures to securely and attractively display such items for examination by consumers.

It is understood that the present embodiments described above are to be considered as illustrative and not restrictive. It will be obvious to those skilled in the art to make various changes, alterations and modifications to the invention described herein. To the extent that these variations, modifications and alterations depart from the scope and spirit of the appended claims, they are intended to be encompassed therein.

I claim:

1. An apparatus for securely displaying a hand-held device on a display structure while allowing said hand-held device to be examined comprising:

a secure clamping means to securely clamp said hand-held device and connect said hand-held device to a tether comprising an upper component and a lower component and a coupling fitting;

a means to extend and to retract said tether comprising a spring activated means, with said spring activated means mounted on a housing plate and with said housing plate having an opening for passage of a tethering cable and with a second end of said tethering cable connected to said spring activated means and with said spring activated means exerting a retracting force when said tethering cable is extended;

a positioning means having a non-circular positioning element to position said clamped device in a fixed orientation when said device is retracted;

said non-circular positioning element being connected to said extending and retracting means;

a complementary positioning element comprising second non-circular positioning element disposed about said opening in said housing plate, and with said cable passing through said opening, and with said complementary positioning element connected to said housing plate by connecting means, and with said complementary positioning element having a lumen to permit passage of said cable, so that said non-circular positioning element and said complementary positioning element mate in a fixed orientation when said tethering cable is completely retracted;

each of said upper component and said lower component comprising said secure clamping means has a bottom element with a first end and a second end, with said bottom element of each component having an inside that receives said hand-held device and an outside.

2. The device according to claim 1 wherein each first end of said components having a bracket to confine said hand-held device within said bottom element, and with each second end comprising an edge, and with each edge having a tab and with each tab being perpendicular to each edge projecting from the outside of each bottom element.

3. The device according to claim 2 with each tab having an opening, and with one of said openings being threaded to receive a screw.

4. The device according to claim 3 wherein said screw has a threaded shaft and a head.

5. The device according to claim 4 wherein said coupling fitting comprises a base, with said base having at least two opposing flat faces for contact with said tabs of said clamping components, and with said opposing flat faces having opposing holes interconnected by a hollow passage through said base to receive said threaded shalt of said screw, and said non-circular positioning element connected to said base to mate with said complementary positioning element.

6. The device according to claim 5 with said tethering cable connected to said non-circular positioning element.

7. The device according to claim 6 with said upper component and said lower component aligned with said coupling fitting so that said tabs are opposed, and each said tab is in contact with an opposed flat face of said coupling fitting, and with said holes of said coupling fitting aligned with said openings of said tabs to receive said screw, and with said edges of said components opposed, so that said bracket of said upper component and said bracket of said lower component are aligned to receive and confine said hand-held device so that said received hand-held device can be securely clamped by inserting said threaded screw through the opening of one of said tabs, and through said opposed holes of said coupling device and tightening said screw in said threaded opening of tab.

8. The apparatus according to claim 7 wherein said spring activated means to extend and retract said tether further comprises:

an axle connected to said housing plate, a spool mounted on said axle, a cable comprising said tethering cable, with said second end of said cable secured to said spool by securing means, with said cable wrapped around said spool and with said spring activated retracting means connected to said spool.

9. The apparatus according to claim 8 wherein said positioning means disposed about said opening in said housing plate is contained within a flange connected to said housing plate.

10. The apparatus according to claim 9 wherein the head of said threaded screw has a slot requiring a key to turn said screw in order to prevent unauthorized loosening of said screw.

11. The apparatus according to claim 10 wherein said means to extend and retract said tether comprises said spool having a first and a second channel with said cable wound on said second channel and with said retracting means comprising a coil of a constant force spring, with said spring coil mounted on said housing plate, and with an end of said spring secured to the first channel of said spool by the securing means and with said spring arranged so that as said cable is pulled, said spring is wound from the coil onto the first channel of said spool, thereby exerting a retracting force on said cable.

12. The apparatus according to claim 11 wherein said non-circular positioning element comprising said coupling fitting is a male component having an ovoid cross-section and said complementary positioning element contained within said flange is a female component comprising a tubular structure, with said tubular structure having a wall that encloses a lumen and with said lumen having an ovoid cross-section.

13. The apparatus according to claim 12 wherein the wall of said tubular structure further comprises a multiplicity of rounded rails that longitudinally traverse said tubular structure within said lumen.

14. An apparatus to securely clamp a hand-held device to a tether comprising:

an upper component and a lower component with each of said components having a bottom element with a first end and a second end, with said bottom element of each component having an inside that receives said hand-held device and an outside, and with each first end of said components having a bracket to confine said hand-held device within said bottom element, and with each second end comprising an edge, and with each edge having a tab and with each tab perpendicular to each edge and each tab projecting from the outside of each bottom element, and with each tab having an opening, and with a one of said openings threaded to receive a screw having a threaded shaft and a head and an other of said openings unthreaded and able to receive only said threaded shaft of said screw, and a coupling fitting, with said coupling fitting comprising a base, with said base having at least two opposing flat faces for contact with said tabs of said clamping components, and with at least two opposing flat faces having opposing holes interconnected by a hollow passage through said base to receive said threaded shaft of said screw, and a non-circular positioning element connected to said base to mate with a complementary positioning element connected to an extending and retracting means, and with a tethering cable connected to said non-circular positioning element, and with said upper component and said lower component aligned with said coupling fitting so that said tabs are opposed, and each said tab is in contact with an opposed flat face of said coupling fitting, and with said holes of said coupling fitting aligned with said openings of said tabs to receive said screw, and with said edges of said components opposed, so that said bracket of said upper component and said bracket of said lower component are aligned to receive said hand-held device so that said received hand-held device can be securely clamped by inserting said threaded screw through said unthreaded opening of said tab, and through said opposed holes of said coupling device and tightening said screw in said threaded opening of said tab.

15. The apparatus according to claim 14 wherein said head of said threaded screw has a slot requiring a key to turn said screw in order to prevent unauthorized loosening of said screw.

16. An apparatus to securely clamp a hand-held device to a tether comprising:

an upper component and a lower component with each of said components having a bottom element with a first end and a second end;

said bottom element of each component having an inside that receives said hand-held device and an outside;

each first end of said components having a bracket to confine said hand-held device within said bottom element;

a means for detachably connecting the upper component and the lower component together so that said bracket of said upper component and said bracket of said lower component are aligned to receive and hold said hand-held device; and a means to connect said upper connecting and said lower component to tethering cable comprising:

a first tab connected to said upper component;

a second tab connected to said lower component;

each tab projecting from the outside of each component;

each tab having an opening;

one of said openings being threaded to receive a screw; and a screw having a threaded shaft that screws into said threaded opening.

17. The apparatus according to claim 16 wherein said second opening is unthreaded opening;

said second opening capable of receiving said threaded shaft of said screw.

18. The apparatus according to claim 16 wherein the head of said threaded screw has a slot requiring a key to turn said screw in order to prevent unauthorized loosening of said screw.

19. The apparatus according to claim 16 having a coupling fitting comprising:

a base;

said base having at least two opposing flat faces for contact with said tabs of said clamping components; and at least two opposing flat faces having opposing holes interconnected by a hollow passage through said base to receive said threaded shaft of said screw.

20. The apparatus according to claim 19 having a non-circular positioning element connected to said base which is configured to mate with a complementary positioning element connected to a tethering cable.

* * * * *